US006867551B2

(12) United States Patent
Okuda

(10) Patent No.: US 6,867,551 B2
(45) Date of Patent: Mar. 15, 2005

(54) LIGHT-EMISSION DRIVE CIRCUIT FOR ORGANIC ELECTROLUMINESCENCE ELEMENT AND DISPLAY DEVICE

(75) Inventor: Yoshiyuki Okuda, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 10/675,977

(22) Filed: Oct. 2, 2003

(65) Prior Publication Data

US 2004/0066359 A1 Apr. 8, 2004

(30) Foreign Application Priority Data

Oct. 3, 2002 (JP) ..... 2002-291175

(51) Int. Cl.[7] ..... G09G 3/10

(52) U.S. Cl. ..... 315/169.3; 345/74.1; 345/76; 345/77; 345/91

(58) Field of Search ..... 315/169.3, 169.1, 315/169.2; 345/74.1, 76, 77, 84, 90, 91, 92

(56) References Cited

U.S. PATENT DOCUMENTS 5,990,629 A * 11/1999 Yamada et al. ..... 315/169.3
6,556,176 B1 * 4/2003 Okuyama et al. ..... 345/76
6,583,775 B1 * 6/2003 Sekiya et al. ..... 345/76
6,587,087 B1 * 7/2003 Ishizuka ..... 345/82

* cited by examiner

*Primary Examiner*—Haissa Philogene
(74) *Attorney, Agent, or Firm*—Sughrue Mion, PLLC

(57) ABSTRACT

An active type of light emission drive circuit includes a switching element which turns on in response to a scan pulse to allow a data signal to pass therethrough, a capacitive element for holding the data signal passed through the switching element during the ON state of the switching element, and a drive element for supplying a forward drive current to an organic EL element in accordance with the data signal held on the capacitive element to allow the organic EL element to emit light. The switching element is formed of a diode element that turns on by the potential difference between the scan pulse and the data signal when the scan pulse is supplied. A display device incorporating the drive circuit is disclosed.

17 Claims, 13 Drawing Sheets

FIG. 4
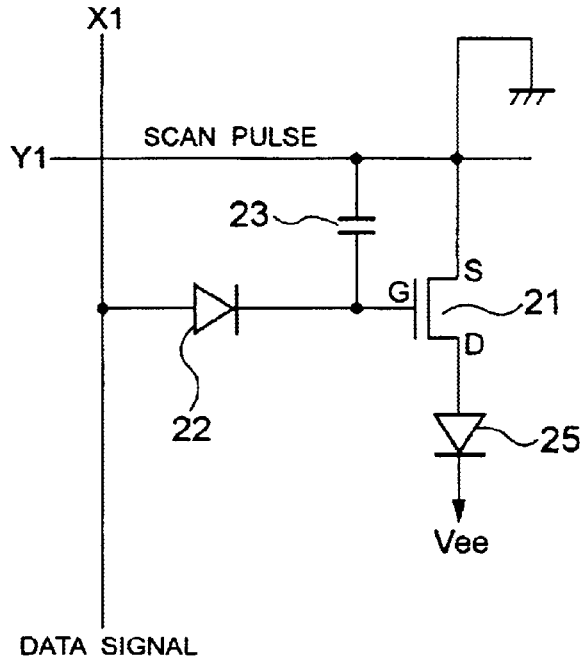
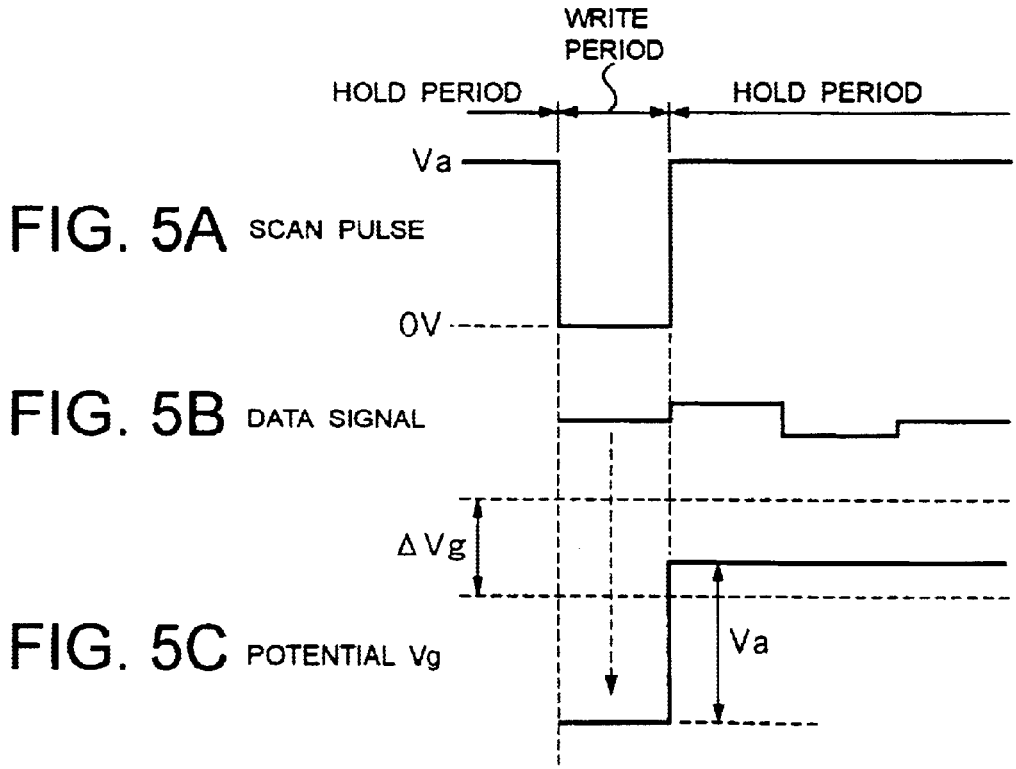

FIG. 6
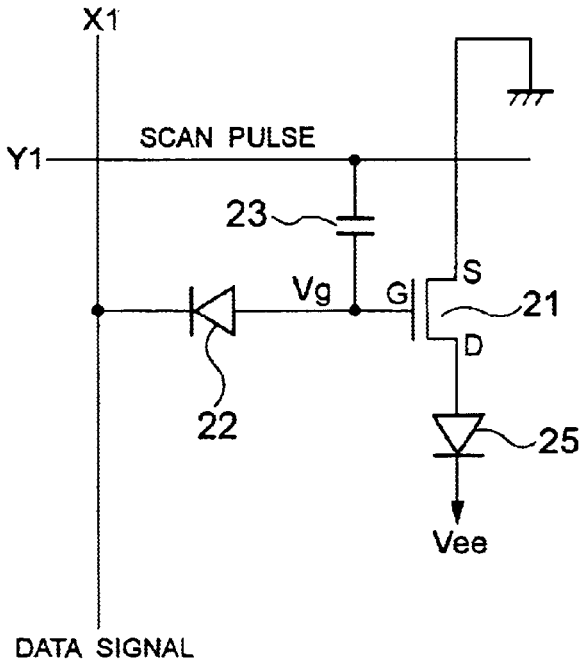
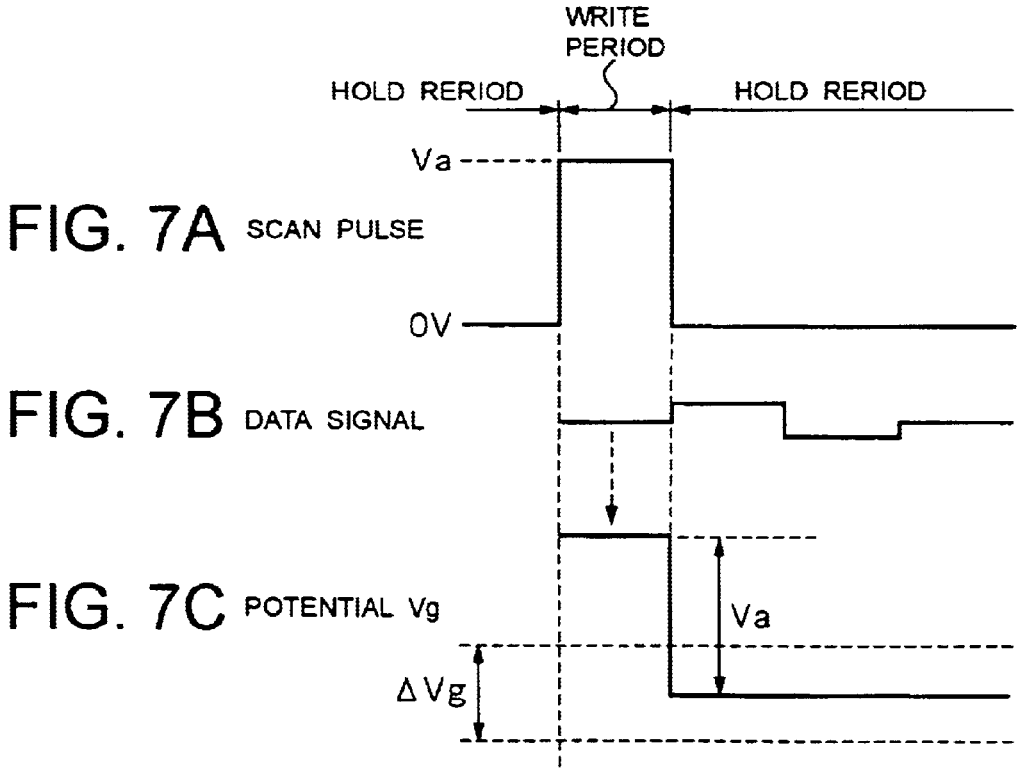

RESET PERIOD
WRITE PERIOD
HOLD PERIOD
HOLD PERIOD

SCAN PULSE OF Y0
Va
0V

SCAN PULSE OF Y1
Va
0V

DATA SIGNAL
ΔVg

POTENTIAL Vg
Va

RESET PERIOD
WRITE PERIOD
HOLD PERIOD
HOLD PERIOD

SCAN PULSE OF Y0
Va
0V

SCAN PULSE OF Y1
Va
0V

DATA SIGNAL

POTENTIAL Vg
Va
ΔVg

RESET PERIOD
WRITE PERIOD
HOLD PERIOD
HOLD PERIOD

Va
SCAN PULSE OF Y0
0V

Va
SCAN PULSE OF Y1
0V

DATA SIGNAL
ΔVg

POTENTIAL Vg
POTENTIAL AT P
Va
POTENTIAL AT P
DIODE 46
ON
OFF
ON

RESET PERIOD
WRITE PERIOD
HOLD PERIOD
HOLD PERIOD

SCAN PULSE OF Y0
Va
0V

SCAN PULSE OF Y1
Va
0V

DATA SIGNAL
POTENTIAL AT P
POTENTIAL AT P

POTENTIAL Vg
Va
ΔVg
DIODE 46
ON
OFF
ON

LIGHT-EMISSION DRIVE CIRCUIT FOR ORGANIC ELECTROLUMINESCENCE ELEMENT AND DISPLAY DEVICE

BACKGROUND OF THE INVENTION

1. Field of the Invention

The present invention relates to a light emission drive circuit for an organic electroluminescence element and a display device incorporating the drive circuit.

2. Description of the Related Art

Conventionally known is a display panel having organic electroluminescence elements (hereinafter simply referred to as organic EL elements), or one type of a capacitive light-emitting element, disposed in a matrix. An active display device designed to drive a display panel having organic EL elements has a light emission drive circuit configured for each pixel as shown in FIG. 1.

The light emission drive circuit for a single pixel shown in FIG. 1, has two FETs (Field Effect Transistors) 1, 2 and a capacitor 3 to drive an EL element 5. The FET 1 serves to write data and its gate G is connected to a scan line Yi to which a scan pulse is supplied, with the source S of the FET 1 being connected to a data line Xj to which a data signal is supplied. The drain D of the FET 1 is connected to the gate G of the FET 2 as well as to one terminal of the capacitor 3. The FET 2 serves to supply a drive current to the EL element 5 to drive the EL element 5, with its source S being connected to the other terminal of the capacitor 3 as well as to a common ground line 6. The drain D of the FET 2 is connected to the anode of the EL element 5, while the cathode of the EL element 5 is supplied with an output voltage Vee, as a negative potential from a power supply (not shown).

Now, the operation of the light emission drive circuit will be described below. First, when a scan pulse is supplied to the gate G of the FET 1 via the scan line Yi, the FET 1 turns on, allowing a current corresponding to the voltage of a data signal supplied via the data line Xj to the source S to flow from the source S to the drain D. During the ON period of the FET 1, the capacitor 3 is charged, and the charge voltage is supplied to the gate G of the FET 2. The FET 2 turns on (in an active state or in its saturation state) in response to the charge voltage. When the FET 2 is in the ON state, a forward voltage greater than or equal to a light emission threshold voltage is applied to the EL element 5 to pass a drive current from the ground line 6 through the source S—the drain D of the FET 2 and the EL element 5, thereby causing the EL element 5 to emit light. When the scan pulse is no longer supplied to the gate G of the FET 1, the FET 1 becomes an OFF state, and the FET 2 allows the charge stored in the capacitor 3 to hold the voltage of the gate G, and maintain the drive current as well as the light emission of the EL element 5 until the EL element 5 is scanned again.

As described above, in the light emission drive circuit for a conventional display device, as the FET 1 for writing a data signal via a data line onto a capacitor, the light emission drive circuit for a conventional display device employs a MOS-FET switching element of an organic semiconductor serving as a channel material. With such a MOS-FET switching element, it is necessary to scale up the MOS-FET itself in order to provide a current flowing therethrough in its ON state and sufficiently large enough to flow through a typical low-temperature polysilicon TFT (Thin Film Transistor) in a display panel. On the other hand, an increase in size of the MOS-FET would cause the parasitic capacitance between the gate and drain of the MOS-FET to increase accordingly. The presence of the gate-drain parasitic capacitance would cause an on-off control pulse signal voltage applied to the gate other than a drain-source ON current to be differentiated by the gate-drain parasitic capacitance into a charge/discharge current, which is in turn introduced into a data hold capacitor resulting in a change in the original capacitor hold voltage. This phenomenon is also found in a typical TFT of a polysilicon-based material. However, since its mobility of carriers of the organic semiconductor material is extremely lower than that of the typical polysilicon-based material, the drain-source current is relatively reduced to degrade the ratio between a current induced by the drain-source parasitic capacitance and the drain-source current. This causes the phenomenon to be evident to such an extent of interfering with the operation of the TFT formed of an organic semiconductor material. As a result, there was a problem that a voltage corresponding to a predetermined desired brightness was not applied to the gate of the FET 2, thereby causing a variation in the light emission brightness of the EL element 5.

SUMMARY OF THE INVENTION

It is therefore an object of the present invention to provide an active light emission drive circuit and a display device which enable an organic EL element to emit light at a brightness corresponding to a data signal without a capacitor hold voltage for holding data being disturbed by an write operation.

An active type of light emission drive circuit according to the present invention comprises: a switching element which turns on in response to an ON command pulse to pass a data signal therethrough; a capacitive element which holds the data signal passed through the switching element during the ON state of the switching element; and a drive element which supplies a forward drive current to an organic electroluminescence element in response to the data signal held in the capacitive element to cause the organic electroluminescence element to emit light, wherein the switching element is a switching diode element which turns on by a potential difference between the ON command pulse and the data signal when the ON command pulse is supplied.

A display device according to the present invention comprises: a display panel having a plurality of data lines, a plurality of scan lines intersecting with the plurality of data lines, and a plurality of sets each of which has an organic electroluminescence element and an active type of light emission drive circuit, the sets being disposed at the respective intersections of the plurality of data lines and the plurality of scan lines; and a controller which supplies a scan pulse in sequence at predetermined time intervals to one scan line of the plurality of scan lines and supplies a data signal to at least one data line of the plurality of data lines to allow an organic electroluminescence element located at an intersecting portion of the one data line and the at least one data line to emit light, wherein the light emission drive circuit includes: a switching diode element which turns on by a potential difference between the scan pulse and the data signal when the scan pulse is supplied through the one scan line; a capacitive element which holds the data signal passed through the diode element while the diode element is in the ON state; and a drive element which supplies a forward drive current to the organic electroluminescence element in response to the data signal held in the capacitive element to cause the organic electroluminescence element to emit light.

BRIEF DESCRIPTION OF THE DRAWINGS

FIG. 4 is a circuit diagram showing a configuration of the light emission drive circuit in the display device of FIG. 2;

FIGS. 5A to 5C are time charts showing the operation of the light emission drive circuit of FIG. 4;

FIG. 6 is a circuit diagram showing another configuration of the light emission drive circuit in the display device of FIG. 2;

FIGS. 7A to 7C are time charts showing the operation of the light emission drive circuit of FIG. 6;

DETAILED DESCRIPTION OF THE INVENTION

Now, the present invention will be explained below in more detail with reference to the accompanying drawings in accordance with the embodiments.

Figure 1:
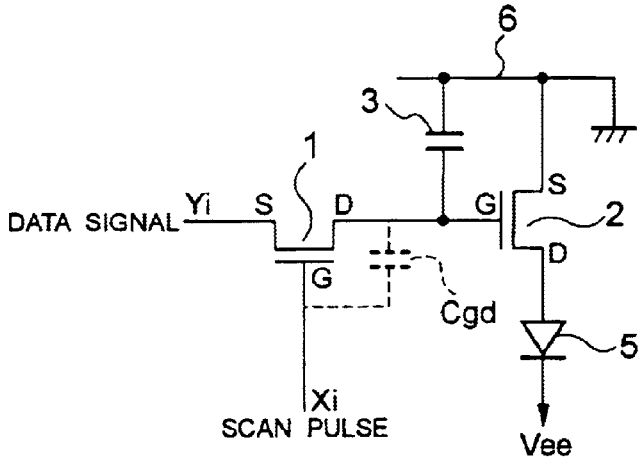
FIG. 1 is a view showing an example of a prior art light emission drive circuit for an organic EL element.
Figure 2:
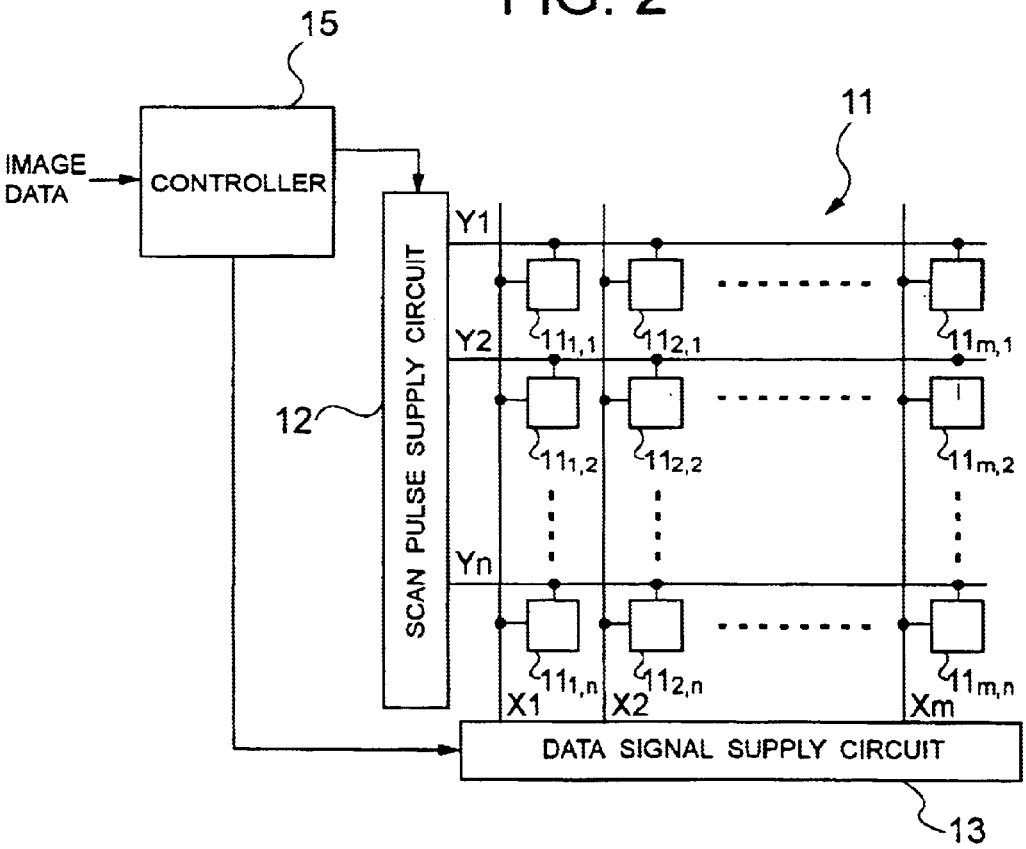
FIG. 2 is a block diagram showing the configuration of a display device to which the present invention is applied.

FIG. 2 shows a display device incorporating a matrix display panel according to the present invention. This display device includes a display panel 11, a scan pulse supply circuit 12, a data signal supply circuit 13, and a controller 15.

The display panel 11 has an active matrix array of m by n pixels, which have EL light emission drive circuits $\mathbf{11}_{1,1}$ to $\mathbf{11}_{m,n}$, respectively, as shown in FIG. 2. The EL light emission drive circuits $\mathbf{11}_{1,1}$ to $\mathbf{11}_{m,n}$ are all configured in the same manner and connected to the scan pulse supply circuit 12 via scan lines Y1 to Yn as well as to the data signal supply circuit 13 via data lines X1 to Xm, respectively. The controller 15 generates a scan control signal and a data control signal in response to input image data. The scan control signal including a Y transfer clock signal and a Y transfer pulse is supplied to the scan pulse supply circuit 12. The data control signal including an X transfer clock signal, an X transfer pulse, and a serial m-bit data signal is supplied to the data signal supply circuit 13. The X transfer clock signal has a higher frequency than the Y transfer clock signal so that m clocks of X transfer clock signals are generated in one clock period of the Y transfer clock signal.

Figure 3:
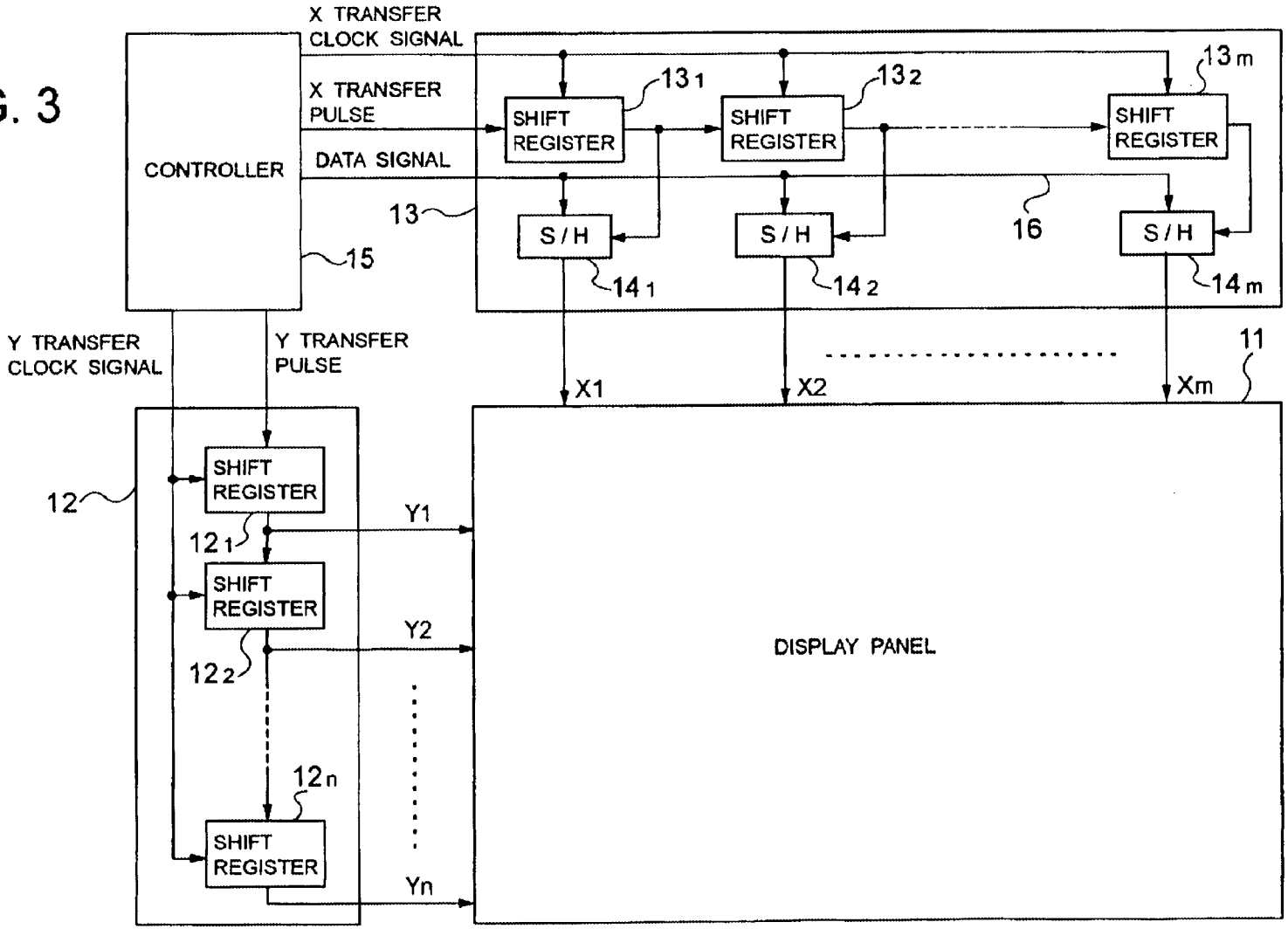
FIG. 3 is a block diagram showing the configuration of a scan pulse supply circuit and a data signal supply circuit in the display device of FIG. 2.

As shown in FIG. 3, the scan pulse supply circuit 12 includes n shift registers $\mathbf{12}_1, \mathbf{12}_2, \ldots, \mathbf{12}_n$ corresponding to the scan lines Y1 to Yn. The shift registers $\mathbf{12}_1, \mathbf{12}_2, \ldots, \mathbf{12}_n$ are connected in series to each other with the output of a shift register being connected to the input of the subsequent one, and designed to transfer the Y transfer pulse sequentially from the shift register $\mathbf{12}_1$ toward the shift register $\mathbf{12}_n$ in response to the Y transfer clock signal. Each output of the shift registers $\mathbf{12}_1, \mathbf{12}_2, \ldots, \mathbf{12}_n$ is connected to the corresponding scan lines Y1 to Yn. Upon reception of the Y transfer pulse, each of the shift registers $\mathbf{12}_1, \mathbf{12}_2, \ldots, \mathbf{12}_n$ delivers the Y transfer pulse to the corresponding scan line as a scan pulse.

As shown in FIG. 3, the data signal supply circuit 13 includes m shift registers $\mathbf{13}_1, \mathbf{13}_2, \ldots, \mathbf{13}_m$ and sample/hold circuits $\mathbf{14}_1, \mathbf{14}_2, \ldots, \mathbf{14}_m$, corresponding to the data lines X1 to Xm. The shift registers $\mathbf{13}_1, \mathbf{13}_2, \ldots, \mathbf{13}_m$ are connected in series to each other with the output of a shift register being connected to the input of the subsequent one, and designed to transfer the X transfer pulse sequentially from the shift register $\mathbf{13}_1$ toward the shift register $\mathbf{13}_m$ in response to the X transfer clock signal. Each output of the shift registers $\mathbf{13}_1, \mathbf{13}_2, \ldots, \mathbf{13}_m$ is connected to the corresponding sample/hold circuits $\mathbf{14}_1, \mathbf{14}_2, \ldots, \mathbf{14}_m$. Upon reception of the X transfer pulse, each of the shift registers $\mathbf{13}_1, \mathbf{13}_2, \ldots, \mathbf{13}_m$ delivers the X transfer pulse to the corresponding sample/hold circuit. The sample/hold circuits $\mathbf{14}_1, \mathbf{14}_2, \ldots, \mathbf{14}_m$ are each supplied with the aforementioned m-bit data signal from the controller 15 via a line 16 and hold one bit of the data signal when the corresponding shift register supplies the X transfer pulse, delivering the held 1-bit data signal to the corresponding data line (any one of the X1 to Xm).

Since the light emission drive circuits $\mathbf{11}_{1,1}$ to $\mathbf{11}_{m,n}$ are configured in the same manner as described above, the configuration of the light emission drive circuit $\mathbf{11}_{1,1}$ will be described below.

As shown in FIG. 4, the light emission drive circuit $\mathbf{11}_{1,1}$ has an FET 21, an organic diode 22, and a capacitor 23 to drive an organic EL element 25. One end of the capacitor 23 is connected to the scan line Y1 to which the scan pulse supply circuit 12 supplies a scan pulse, while the anode of the organic diode 22 is connected to the data line X1 to which a data signal is supplied. The cathode of the organic diode 22 and the other end of the capacitor 23 are connected to each other as well as to the gate of the FET 21. The source of the FET 21 is grounded, while the drain is connected to the anode of the organic EL element 25. The cathode of the organic EL element 25 is supplied with the output voltage Vee of the power supply (not shown).

Now, the operation of the light emission drive circuit $\mathbf{11}_{1,1}$ for allowing the organic EL element 25 to emit light will be described below. First, a scan pulse is supplied to one end of the capacitor 23 from the scan pulse supply circuit 12 via the scan line Y1. The scan pulse is a write pulse for writing a data signal on the capacitor 23. As shown in FIG. 5A, the scan line Y1 has potential Va (Va>0V) except for a write period, but is reduced to 0V by the scan pulse during the write period. During the write period, the anode of the organic diode 22 is supplied via the data line X1 with the data signal (see FIG. 5B). The level of the data signal causes the diode 22 to be turned on and its potential level is applied to the other end of the capacitor 23. The potential level of the data signal is greater than 0V. The capacitor 23 is charged at the potential level of the data signal, to that potential level of which the potential Vg of the other end of the capacitor 23 becomes substantially equal. The potential Vg at which the diode 22 is in an ON state is applied to the gate of the FET 21; however, the FET 21 is in an OFF state at that potential Vg.

When the scan pulse ends the write period, the light emission drive circuit $11_{1,1}$ now in a hold period, causes the potential of the scan line Y1 to change from 0V to Va. This in turn causes the capacitor 23 to hold the charge stored thereon and the potential Vg of the other end of the capacitor 23 to increase by Va from the hold level at the point in time of ending the write operation, as shown in FIG. 5C. The diode 22 is reverse biased and thus turned off. On the other hand, the FET 21 to the gate of which the potential Vg increased by Va is applied is in an ON state (including an active state) corresponding to the level of the potential Vg. Accordingly, a drive current responsive to the conduction state of the FET 21 flows through the organic EL element 25, which in turn emits light. The light-emission brightness corresponds to the value of the drive current.

The diode 22 shown in FIG. 4 may also be disposed opposite in polarity as shown in FIG. 6. Now, the operation of the light emission drive circuit $11_{1,1}$, shown in FIG. 6, for allowing the organic EL element 25 to emit light will be described below. First, a scan pulse is supplied to one end of the capacitor 23 from the scan pulse supply circuit 12 via the scan line Y1. As shown in FIG. 7A, the scan line Y1 has potential 0V except for a write period, but is increased to Va by the scan pulse during the write period. During the write period, the cathode of the diode 22 is supplied via the data line X1 with a data signal (see FIG. 7B). The potential level of the data signal causes the diode 22 to be turned on and its potential level is applied to the other end of the capacitor 23. The potential level of the data signal is less than 0V. The capacitor 23 is charged at the potential level of the data signal, to that potential level of which the potential Vg of the other end of the capacitor 23 becomes substantially equal. The potential Vg at which the diode 22 is in an ON state is applied to the gate of the FET 21; however, the FET 21 is in an OFF state at that potential Vg.

When the scan pulse ends the write period, the light emission drive circuit $11_{1,1}$, now in a hold period, causes the potential of the scan line Y1 to change from Va to 0V. This in turn causes the capacitor 23 to hold the charge stored thereon and the potential Vg of the other end of the capacitor 23 to decrease by Va from the hold level at the point in time of ending the write operation, as shown in FIG. 7C. The diode 22 is reverse biased and thus turned off. On the other hand, the FET 21 to the gate of which the potential Vg decreased by Va is applied is in an ON state (including an active state) corresponding to the level of the potential Vg. Accordingly, a drive current responsive to the conduction state of the FET 21 flows through the organic EL element 25, which in turn emits light. The light-emission brightness corresponds to the value of the drive current.

In FIGS. 5C and 7C, ΔVg indicates the range over which the potential Vg varies with the capacitor 23 being charged or discharged and the FET 21 being turned on or off. The level of the data signal is predefined within this range in consideration of Va. At the time of a write operation, the level of the data signal is varied, thereby causing the drive current through the organic EL element 25 to vary and resulting in a change in light emission brightness.

As described with reference to each of the aforementioned embodiments, the organic diode element can be used as a switching element for writing the data signal to write the data signal at higher speeds when compared with a light emission drive circuit employing the organic MOS-FET in a prior art display device, and as well applied to a moving image according to a video signal. Furthermore, the diode element can provide a large current in a small area, thereby reducing the stray capacitance of the diode element as well as leakage to the capacitor caused by a distortion in pulse waveform at its rising and trailing edges. Accordingly, it is possible to prevent the light emission brightness of the EL element from being disturbed.

Figure 8:
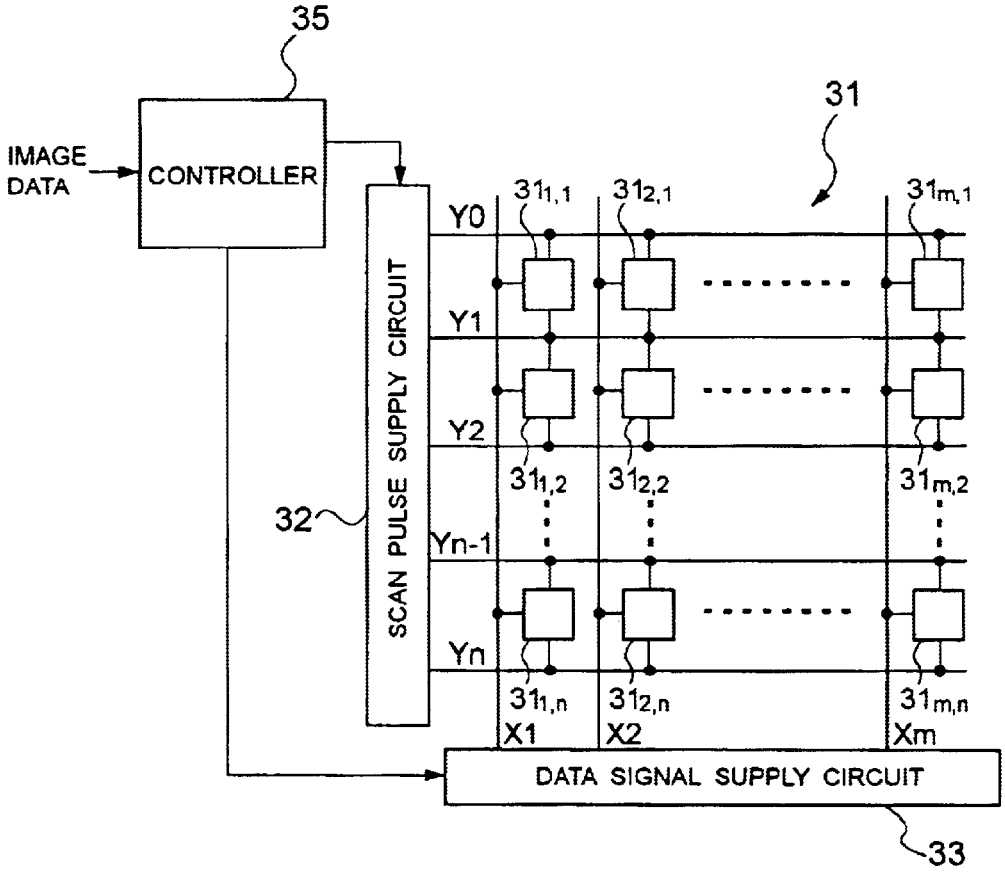
FIG. 8 is a block diagram showing the configuration of another display device to which the present invention is applied.

FIG. 8 illustrates a display device according to another embodiment of the present invention. This display device includes a display panel 31, a scan pulse supply circuit 32, a data signal supply circuit 33, and a controller 35. This display device is different from the one shown in FIG. 2 in that scan lines Y0 to Yn are provided. The scan pulse supply circuit 32 in the device of FIG. 8 includes an additional shift register for the scan line Y0.

Figure 9:
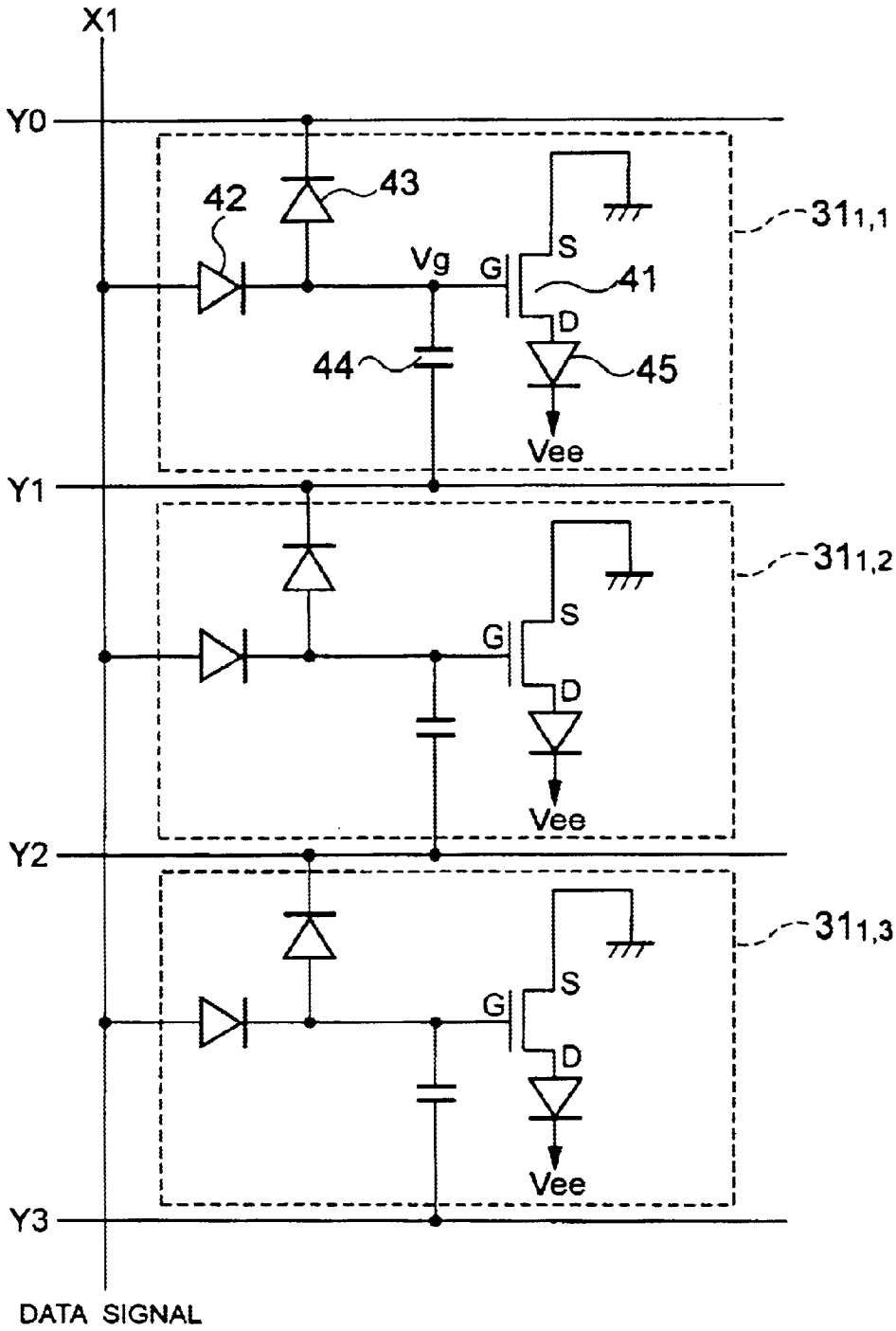
FIG. 9 is a circuit diagram showing a configuration of the light emission drive circuit in the display device of FIG. 8.

Since light emission drive circuits $31_{1,1}$ to $31_{m,n}$ on the display panel 31 in the display device of FIG. 8 are all configured in the same manner, FIG. 9 shows the arrangement of only the three light emission drive circuits $31_{1,1}$ to $31_{1,3}$.

As shown in FIG. 9, the light emission drive circuit $31_{1,1}$ has an FET 41, organic diodes 42, 43, and a capacitor 44, to drive an organic EL element 45. The organic diode 42 serves to write data, while the organic diode 43 serves for a reset operation. The anode of the organic diode 42 is connected to the data line X1, while the cathode is connected to the anode of the organic diode 43. The cathode of the organic diode 43 is connected to the scan line Y0. One end of the capacitor 44 is connected to the scan line Y1, while the other end is connected to a common connection line of the organic diodes 42, 43 as well as to the gate of the FET 41. The source of the FET 41 is grounded, while the drain is connected to the anode of the organic EL element 45. The cathode of the organic EL element 45 is supplied with the output voltage Vee of the power supply (not shown).

The light emission drive circuits $31_{1,1}$ and $31_{1,2}$ are configured in the same manner as the light emission drive circuit $31_{1,1}$. The light emission drive circuit $31_{1,2}$ is connected to the scan lines Y1, Y2 as well as to the data line X1, while the light emission drive circuit $31_{1,3}$ is connected to the scan lines Y2, Y3 as well as to the data line X1.

Figures 10A, 10B, 10C, 10D:
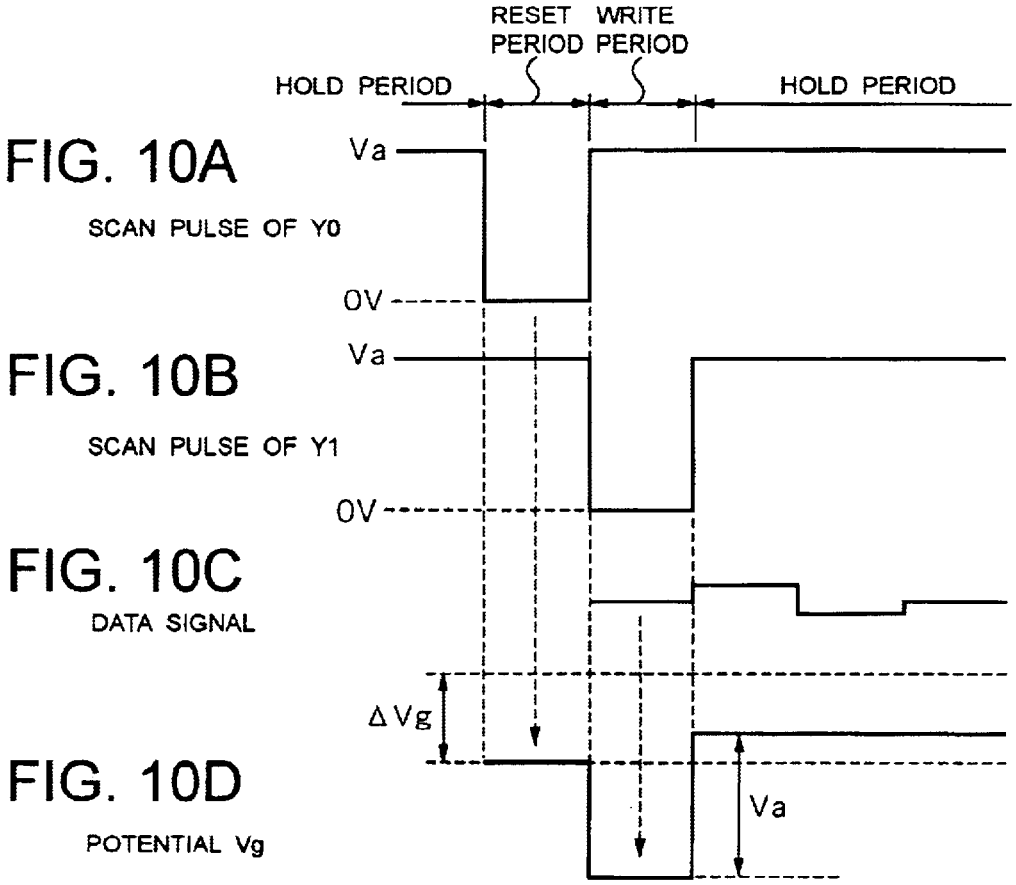
FIGS. 10A to 10D are time charts showing the operation of the light emission drive circuit of FIG. 9.

The scan pulse supply circuit 32 generates the scan pulse in sequence from the scan line Y0 toward Yn. A scan line is at 0V when the scan pulse is supplied thereto and the other scan lines are at potential Va. First, the scan pulse from the scan line Y0 is supplied to the light emission drive circuit $31_{1,1}$ as a reset signal. As shown in FIG. 10A, since this reset signal is at 0V, the organic diode 43 is turned on unless the gate potential Vg of the FET 41 is at the lowest level in the range of ΔVg during a hold period. Turning on the organic diode 43 would cause the gate potential Vg to be at the lowest level in the range of ΔVg. Accordingly, this means that the light emission drive circuit $31_{1,1}$ has been reset. The range ΔVg is the range over which the potential Vg can be varied by the capacitor 44 being charged or discharged and the FET 41 being turned on or off.

Then, when the scan pulse supply circuit 32 stops supplying the scan pulse to the scan line Y0, the scan line Y0 is at potential Va to turn off the organic diode 43. Thereafter, the scan pulse supply circuit 32 supplies the scan pulse to one end of the capacitor 44 via the scan line Y1. This scan pulse serves as an address signal for writing the data signal to the capacitor 44. As shown in FIG. 10B, the scan line Y1 is at potential Va except for a write period, but is reduced to 0V by the scan pulse during the write period. During the write period, as shown in FIG. 10C, the anode of the organic diode 42 is supplied via the data line X1 with the data signal. The level of the data signal causes the diode 42 to be turned on and its potential level is applied to the other end of the capacitor 44. The potential Vg at the other end of the capacitor 44 varies as shown in FIG. 10D. That is, the capacitor 44 is charged at the potential level of the data signal, to that potential level of which the potential Vg becomes substantially equal. The potential Vg at which the diode 42 is in an ON state is applied to the gate of the FET 41; however, the FET 41 is in an OFF state at that potential Vg.

The scan pulse of the scan line Y1 is supplied to the light emission drive circuit $\mathbf{31}_{1,2}$ as a reset signal. Like the light emission drive circuit $\mathbf{31}_{1,1}$ being reset as described above, the light emission drive circuit $\mathbf{31}_{1,2}$ is also reset.

When the scan pulse ends the write period via the scan line Y1, the light emission drive circuit $\mathbf{31}_{1,1}$, now in a hold period, causes the potential of the scan line Y1 to change from 0V to Va. This in turn causes the capacitor 44 to hold the charge stored thereon and the potential Vg of the other end of the capacitor 44 to increase by Va from the hold level at the point in time of ending the write operation, as shown in FIG. 10D. The diode 42 is reverse biased and thus turned off. On the other hand, the FET 41 to the gate of which the potential Vg increased by Va is applied is in an ON state (including an active state) corresponding to the level of the potential Vg. Accordingly, a drive current responsive to the conduction state of the FET 41 flows through the organic EL element 45, which in turn emits light. The light-emission brightness corresponds to the value of the drive current.

Figure 11:
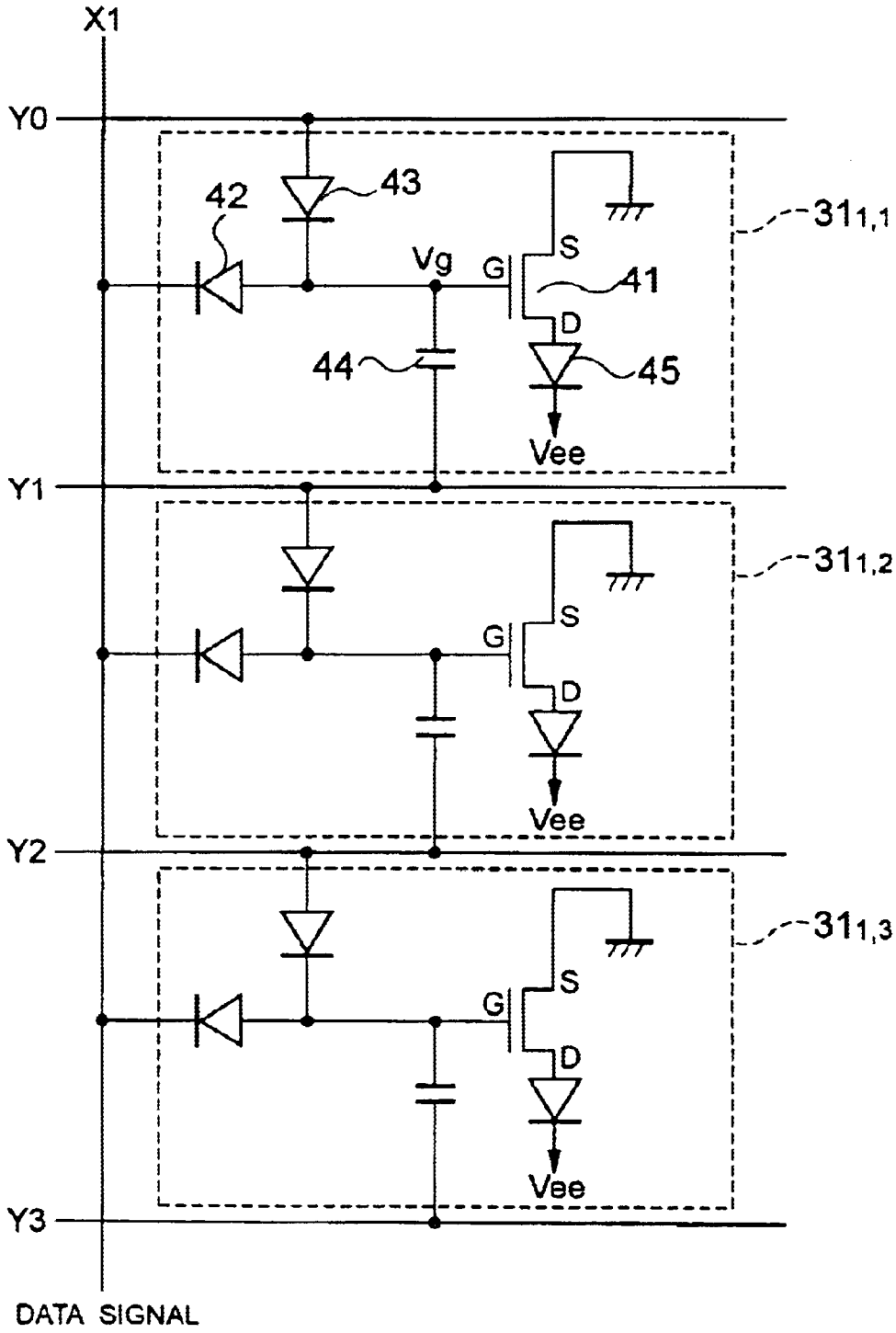
FIG. 11 is a circuit diagram showing another configuration of the light emission drive circuit in the display device of FIG. 8.
Figures 12A, 12B, 12C, 12D:
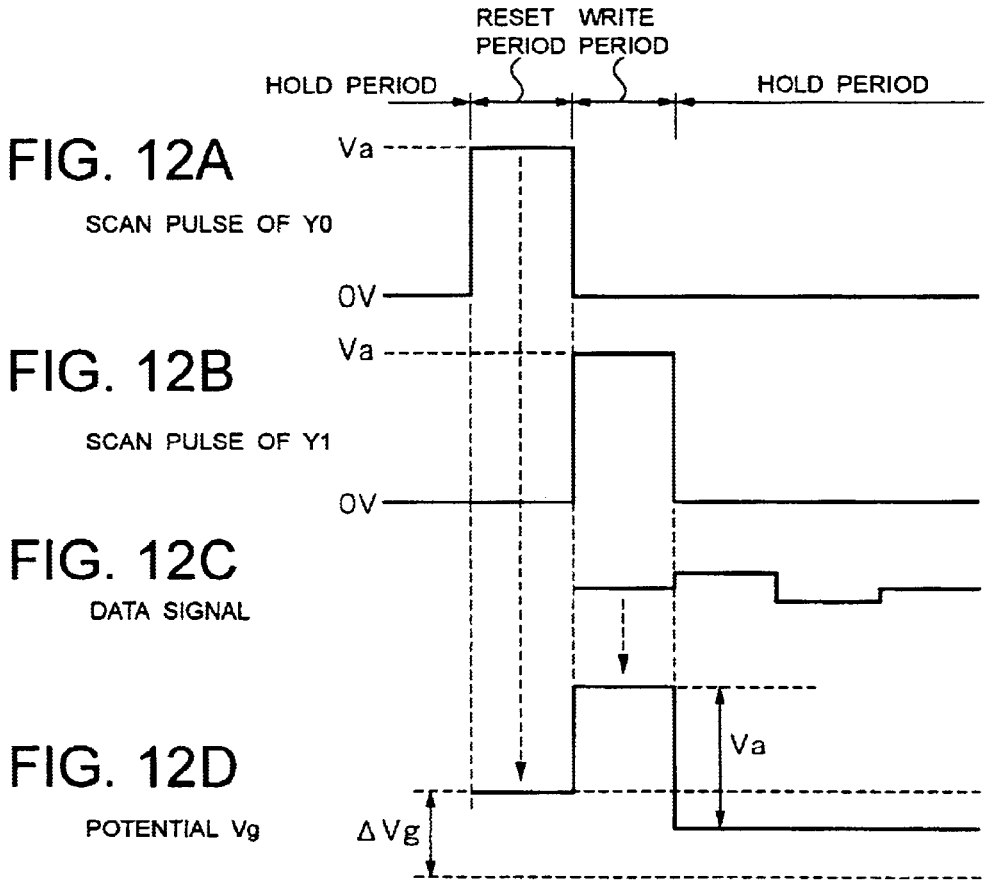
FIGS. 12A to 12D are time charts showing the operation of the light emission drive circuit of FIG. 11.

The organic diodes 42, 43 shown in FIG. 9 may also be disposed opposite in polarity as shown in FIG. 11. In the arrangement of FIG. 11, a scan line is at potential Va when the scan pulse is supplied thereto and the other scan lines are at a potential of 0V. First, the scan pulse from the scan line Y0 is supplied to the light emission drive circuit $\mathbf{31}_{1,1}$ as a reset signal. As shown in FIG. 12A, since this reset signal is at Va, the organic diode 43 is turned on unless the gate potential Vg of the FET 41 is at the highest level in the range of ΔVg during a hold period. As shown in FIG. 12D, turning on the organic diode 43 would cause the gate potential Vg to be at the highest level in the range of ΔVg. Accordingly, this means that the light emission drive circuit $\mathbf{31}_{1,1}$ has been reset. The subsequent operations are the same as those for the light emission drive circuit $\mathbf{11}_{1,1}$ shown in FIG. 6.

Figure 13:
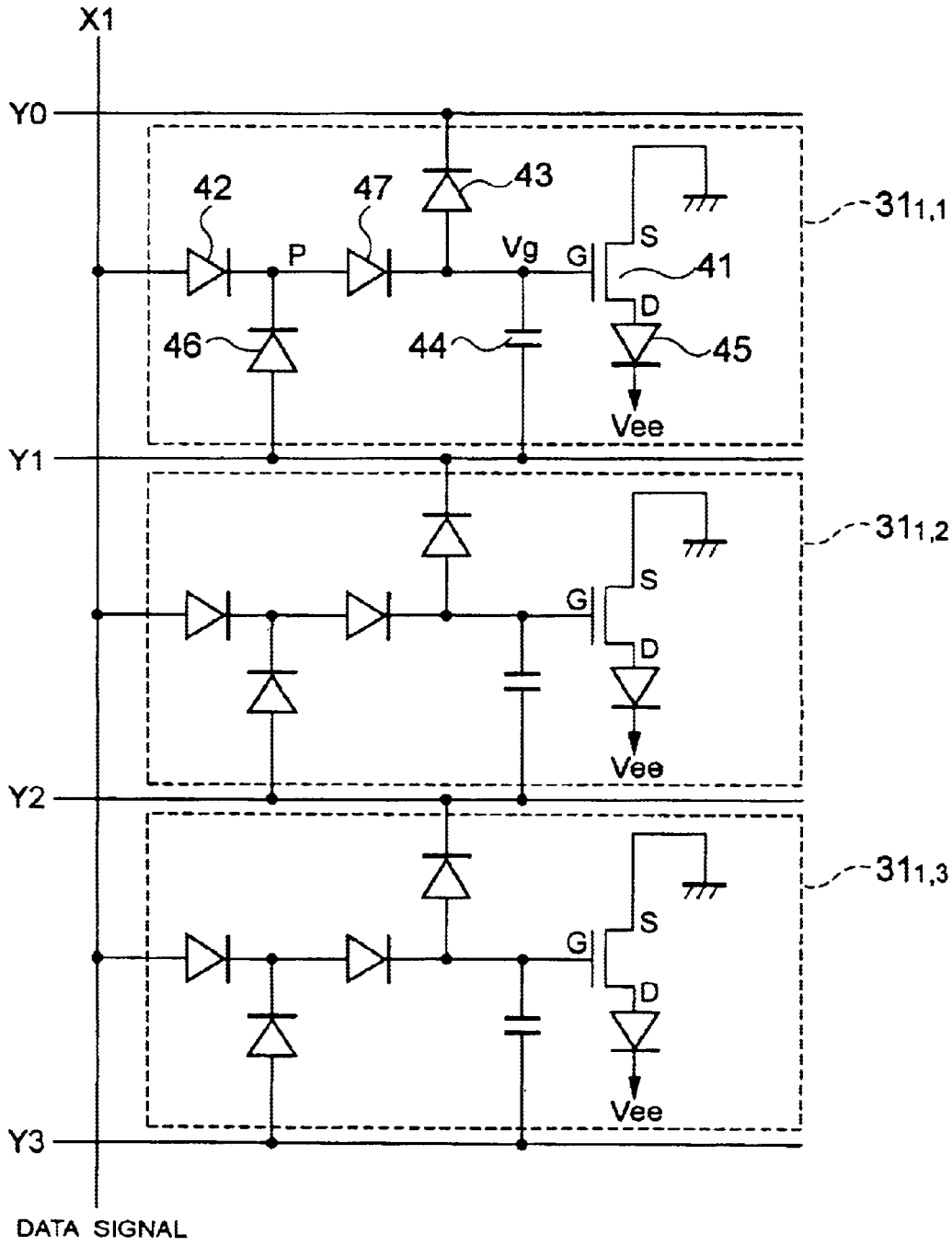
FIG. 13 is a circuit diagram showing another configuration of the light emission drive circuit in the display device of FIG. 8.

The light emission drive circuits $\mathbf{31}_{1,1}$ to $\mathbf{31}_{m,n}$ on the display panel 31 in the display device of FIG. 8 can also be configured as shown in FIG. 13.

As shown in FIG. 13, the light emission drive circuit $\mathbf{31}_{1,1}$ has the FET 41, organic diodes 42, 43, 46, 47 and the capacitor 44 to drive the organic EL element 45. The organic diodes 46, 47 are added to the circuit of FIG. 9, and form a crosstalk suppressor circuit. The organic diode 47 is a first diode element, and the organic diode 46 is a second diode element. The anode of the organic diode 42 is connected to the data line X1, while the cathode is connected to the cathode of the organic diode 46 as well as to the anode of the organic diode 47. The cathode of the organic diode 47 is connected to the anode of the organic diode 43. The cathode of the organic diode 43 is connected to the scan line Y0. The anode of the organic diode 46 is connected to one end of the capacitor 44 as well as to the scan line Y1. The other end of the capacitor 44 is connected to a common connection line of the organic diodes 43, 47 as well as to the gate of the FET 41. The source of the FET 41 is grounded, while the drain is connected to the anode of the organic EL element 45. The cathode of the EL element 45 is supplied with the output voltage Vee of the power supply (not shown).

In FIG. 13, the light emission drive circuits $\mathbf{31}_{1,2}$ and $\mathbf{31}_{1,3}$ are configured in the same manner as the light emission drive circuit $\mathbf{31}_{1,1}$. The light emission drive circuit $\mathbf{31}_{1,2}$ is connected to the scan lines Y1, Y2 as well as to the data line X1, while the light emission drive circuit $\mathbf{31}_{1,3}$ is connected to the scan lines Y2, Y3 as well as to the data line X1.

Figures 14A, 14B, 14C, 14D:
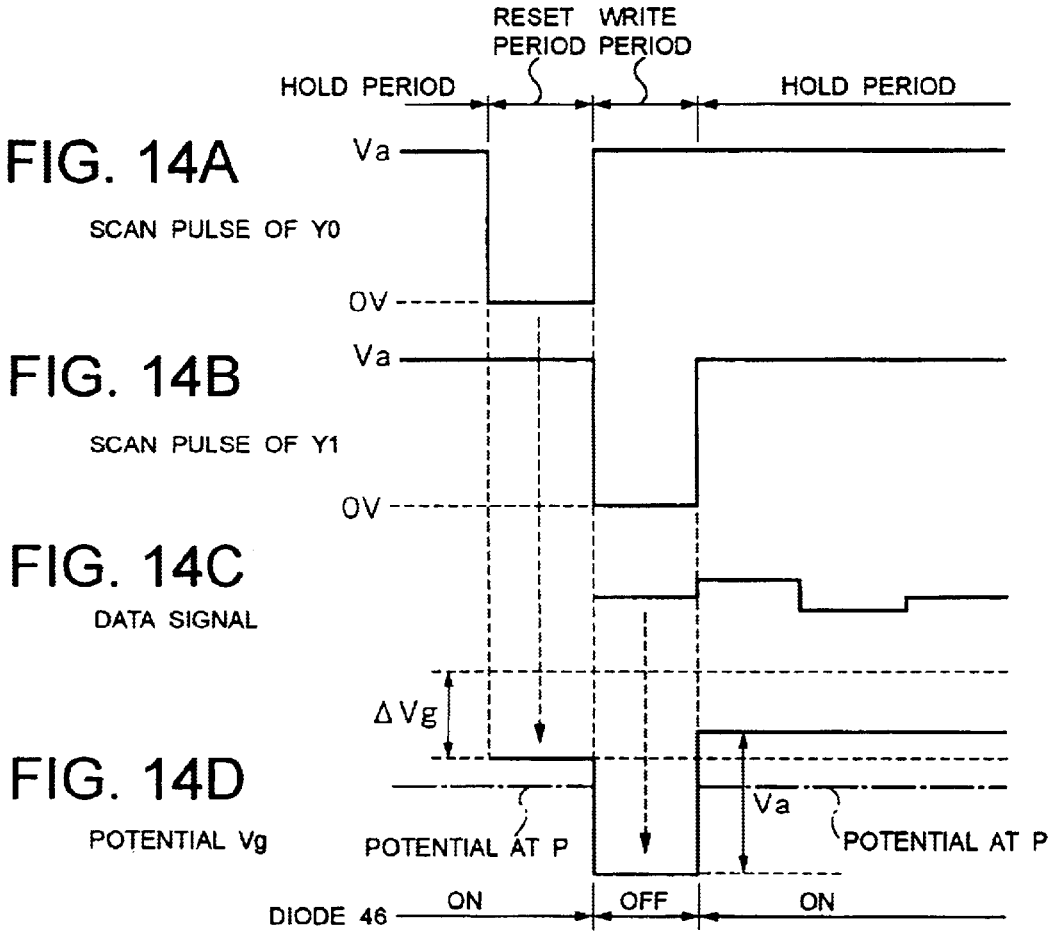
FIGS. 14A to 14D are time charts showing the operation of the light emission drive circuit of FIG. 13.

The operations of the light emission drive circuit $\mathbf{31}_{1,1}$ of FIG. 13 during a reset period and a write period are substantially the same as those of the light emission drive circuit $\mathbf{31}_{1,1}$ shown in FIG. 9. That is, first, the scan pulse from the scan line Y0 is supplied as a reset signal. As shown in FIG. 14A, since this reset signal is at 0V, the organic diode 43 is turned on unless the gate potential Vg of the FET 41 is at the lowest level in the range of ΔVg during a hold period. Turning on the organic diode 43 would cause the gate potential Vg to be at the lowest level in the range of ΔVg. Accordingly, this means that the light emission drive circuit $\mathbf{31}_{1,1}$ has been reset.

Then, when the scan pulse supply circuit 32 stops supplying the scan pulse to the scan line Y0, the scan line Y0 is at potential Va to turn off the organic diode 43. Thereafter, the scan pulse supply circuit 32 supplies the scan pulse to one end of the capacitor 44 via the scan line Y1. This scan pulse serves as an address signal for writing the data signal to the capacitor 44. As shown in FIG. 14B, this scan pulse is at potential Va except for a write period, but is reduced to 0V during the write period. During the write period, as shown in FIG. 14C, the anode of the organic diode 42 is supplied via the data line X1 with the data signal. The potential level of the data signal causes the serially connected diode 42 and diode 47 to be each turned on and the potential level is applied to the other end of the capacitor 44. The organic diode 46 is in an OFF state at that time. The potential Vg at the other end of the capacitor 44, which is charged at the potential level of the data signal, becomes substantially equal to that potential level of the data signal. The potential Vg at which the diode 42 and the diode 47 are in an ON state is applied to the gate of the FET 41; however, the FET 41 is in an OFF state at that potential Vg.

The scan pulse of the scan line Y1 is supplied to the light emission drive circuit $\mathbf{31}_{1,2}$ as a reset signal. Like the light emission drive circuit $\mathbf{31}_{1,1}$ being reset as described above, the light emission drive circuit $\mathbf{31}_{1,2}$ is also reset.

When the scan pulse ends the write period via the scan line Y1, the light emission drive circuit $\mathbf{31}_{1,1}$, now in a hold period, causes the potential of the scan line Y1 to change from 0V to Va. This in turn causes the capacitor 44 to hold the charge stored thereon and the potential Vg of the other end of the capacitor 44 to increase by Va from the hold level at the point in time of ending the write operation, as shown in FIG. 14D. The diode 42 and the diode 47 are reverse biased and thus turned off. On the other hand, the FET 41 to the gate of which the potential Vg increased by Va is applied is in an ON state (including an active state) corresponding to the level of the potential Vg. Accordingly, a drive current responsive to the conduction state of the FET 41 flows through the organic EL element 45, which in turn emits light. The light-emission brightness corresponds to the value of the drive current.

During this hold period, the diode 46 is turned on according to the potential at connection point P between the diode 42 and the diode 47. As shown in FIG. 14D, turning on the diode 46 would cause the potential at the connection point P to be fixed and substantially equal to Va. This allows the diode 47 to be reverse biased and remain in the OFF state. Thus, even with a variation in level of the data signal of the data line X1 being caused by the other light emission drive circuits being scanned, this variation would cause the stray capacitance of the diode 42 in its OFF state to have no effect on the level of the potential Vg, thereby making it possible to prevent cross talk.

Figure 15:
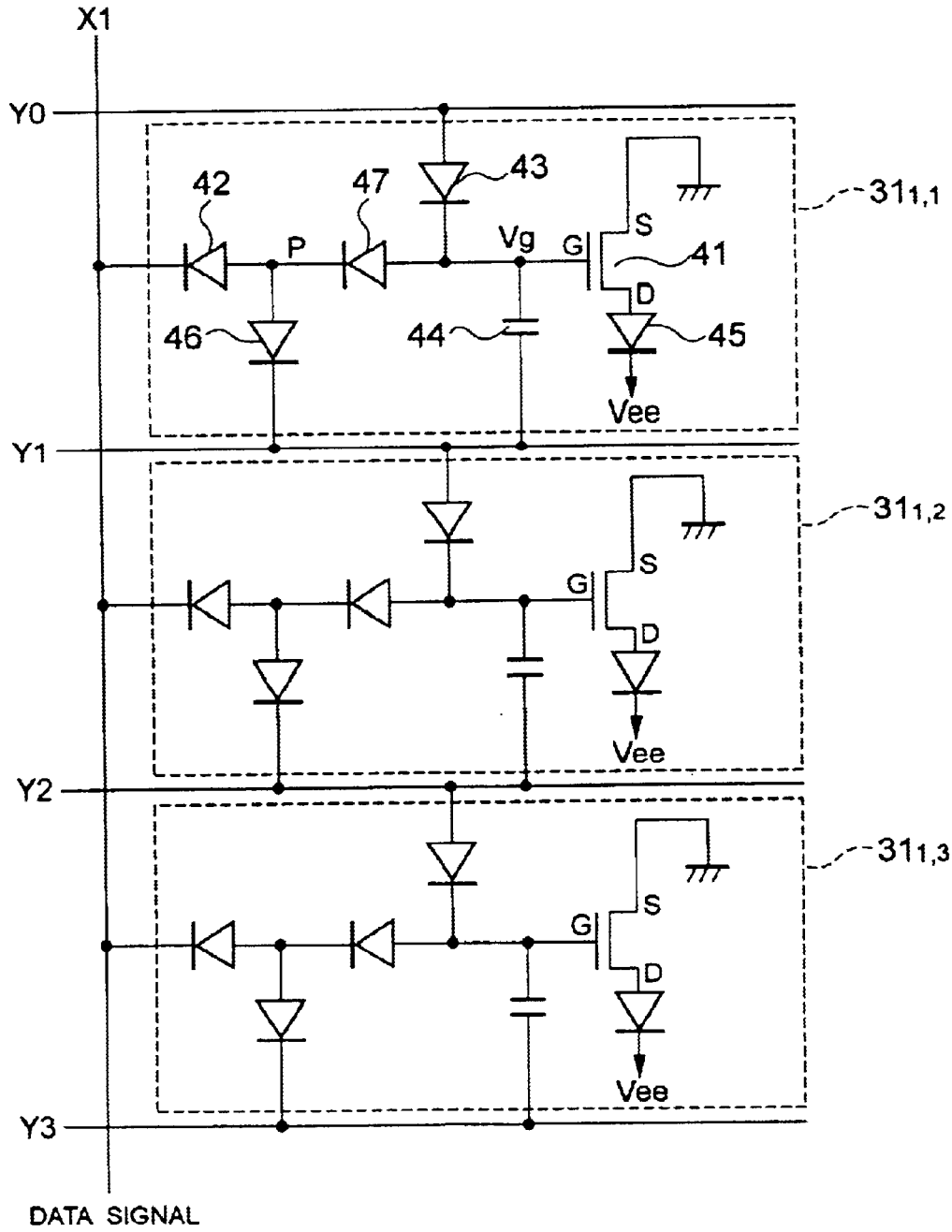
FIG. 15 is a circuit diagram showing another configuration of the light emission drive circuit in the display device of FIG. 8.
Figures 16A, 16B, 16C, 16D:
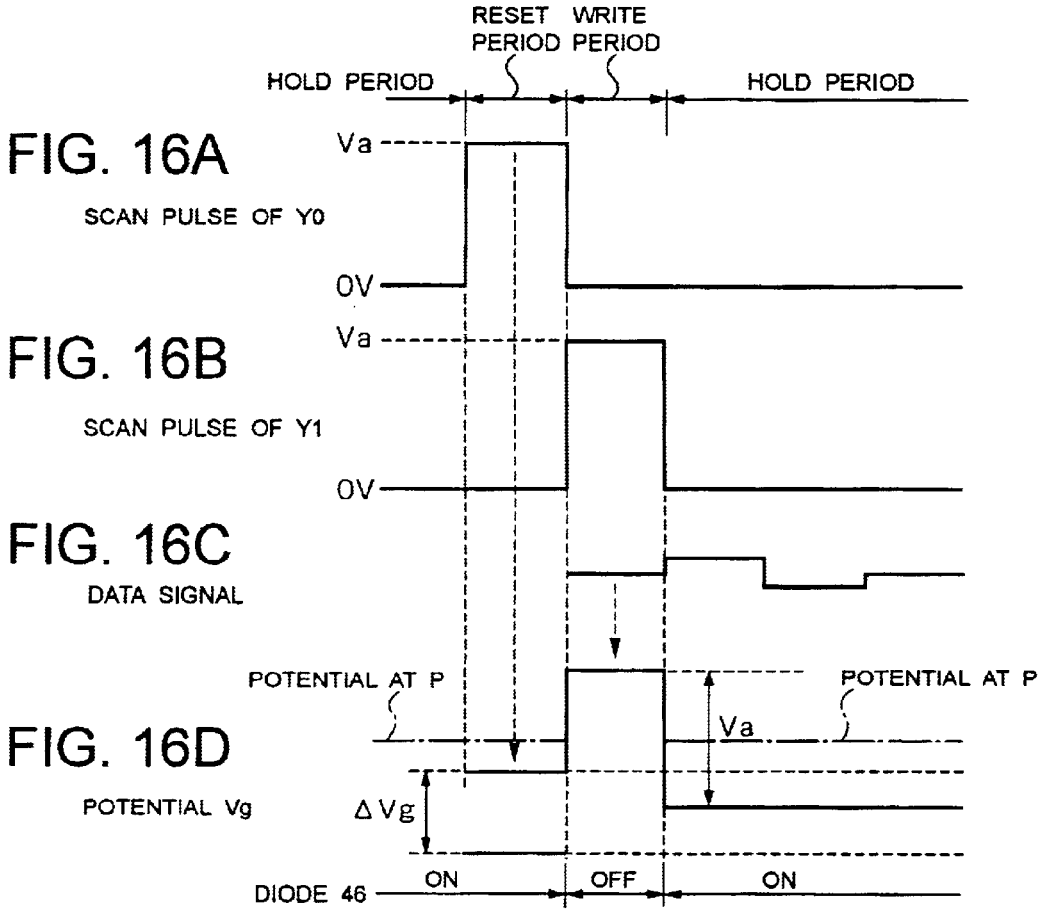
FIGS. 16A to 16D are time charts showing the operation of the light emission drive circuit of FIG. 15.

The organic diodes 42, 43, 46, 47 shown in FIG. 13 may also be disposed opposite in polarity as shown in FIG. 15. Like the light emission drive circuit $\mathbf{11}_{1,1}$ being operated as shown in FIG. 13, the light emission drive circuits $\mathbf{31}_{1,1}$ to $\mathbf{31}_{m,n}$ shown in FIG. 15 are also operated such that the diode 46 is turned on according to the potential at the connection point P between the diode 42 and the diode 47 during a hold period, with the potential at the connection point P between the diode 42 and the diode 47 being fixed as shown in FIG. 16D. This makes it possible to prevent cross talk caused by the stray capacitance of the diode 42 in its OFF state.

On the other hand, it is also possible to employ a capacitor in place of the diode 46. The arrangement for preventing crosstalk caused by the diodes 46 and 47 can also be added to an arrangement that includes no reset operation function of FIG. 4 or 6.

In each of the aforementioned embodiments, a light emission drive circuit for a single pixel has been illustrated; however, for color display, three or R, G, and B light emission drive circuits constitute one pixel.

Furthermore, in each of the aforementioned embodiments, the present invention is implemented as a light emission drive circuit for use with a display panel, but may also be applicable to an independent light emission drive circuit. The independent light emission drive circuit would be supplied with an ON command pulse, in place of the scan pulse, to turn on a switching element for writing data in the light emission drive circuit.

As described above, according to the present invention, an organic EL element is allowed to emit light at a brightness corresponding to a data signal without having to scale up a switching element for writing the data signal.

This application is based on a Japanese Patent Application No. 2002-291175 which is hereby incorporated by reference.

What is claimed is:

1. An active type of light emission drive circuit, comprising:

a switching element which turns on in response to an ON command pulse to pass a data signal therethrough;

a capacitive element which holds said data signal passed through said switching element during the ON state of said switching element; and a drive element which supplies a forward drive current to an organic electroluminescence element in response to said data signal held in said capacitive element to cause said organic electroluminescence element to emit light, wherein said switching element is a switching diode element which turns on by a potential difference between said ON command pulse and said data signal when said ON command pulse is supplied.

2. The light emission drive circuit according to claim 1, wherein one end of said capacitive element is supplied with said ON command pulse, one end of said diode element is supplied with said data signal and the other end of said diode element is connected to the other end of said capacitive element, and when said diode element changes from the ON state to an OFF states, a potential at a connection point between said capacitive element and said diode element varies by a value of an amplitude of said ON command pulse, and said drive element turns on in response to a potential at said connection point during the ON state of said switching element, thereby supplying said drive current to said organic electroluminescence element.

3. The light emission drive circuit according to claim 1, wherein said diode element is an organic diode element.

4. The light emission drive circuit according to claim 2, further comprising a reset circuit which supplies a reset pulse to said connection point immediately before said ON command pulse is generated, thereby changing the potential at said connection point to a first predetermined potential.

5. The light emission drive circuit according to claim 4, wherein said reset circuit comprises a diode element.

6. The light emission drive circuit according to claim 2, further comprising a crosstalk suppressor circuit which is inserted between said capacitive element and said switching diode element, and which cuts a connection between said capacitive element and said switching diode element during the OFF state of said switching diode element.

7. The light emission drive circuit according to claim 6, wherein said crosstalk suppressor circuit includes:

a first diode element inserted in the same direction of polarity as that of said switching diode element between said capacitive element and said switching diode element; and a second diode element which has one end connected to a connection point between said switching diode element and said first diode element, and becomes an ON state during the OFF state of said switching diode element, thereby providing a second predetermined potential to the connection point between said switching diode element and said first diode element to allow said first diode element to be in an OFF state.

8. The light emission drive circuit according to claim 7, wherein the other end of said second diode element is connected to a line along with the one end of said capacitive element.

9. A display device comprising:

a display panel having a plurality of data lines, a plurality of scan lines intersecting with said plurality of data lines, and a plurality of sets each of which has an organic electroluminescence element and an active type of light emission drive circuit, the sets being disposed at the respective intersections of said plurality of data lines and said plurality of scan lines; and a controller which supplies a scan pulse in sequence at predetermined time intervals to one scan line of said plurality of scan lines and supplies a data signal to at least one data line of said plurality of data lines to allow an organic electroluminescence element located at an intersecting portion of said one data line and said at least one data line to emit light, wherein said light emission drive circuit includes:

a switching diode element which turns on by a potential difference between said scan pulse and said data signal when said scan pulse is supplied through said one scan line;

a capacitive element which holds said data signal passed through said diode element while said diode element is in the ON state; and a drive element which supplies a forward drive current to said organic electroluminescence element in response to said data signal held in said capacitive element to cause said organic electroluminescence element to emit light.

10. The display device according to claim 9, wherein one end of said capacitive element is supplied with said scan pulse, one end of said switching diode element is supplied with said data signal and the other end of said switching diode element is connected to the other end of said capacitive element, and when said switching diode element changes from the ON state to an OFF state, a potential at a connection point between said capacitive element and said first diode element varies by a value of an amplitude of said scan pulse, and said drive element turns on in response to a potential at said connection point during the ON state of said switching element, thereby supplying said drive current to said organic electroluminescence element.

11. The display device according to claim 9, wherein said switching diode element is an organic diode element.

12. The display device according to claim 10, further comprising a reset circuit which supplies a reset pulse to said connection point immediately before said scan pulse is generated, thereby changing the potential at said connection point to a first predetermined potential.

13. The display device according to claim 12, wherein said reset circuit includes a diode element.

14. The display device according to claim 12, wherein said reset pulse is said scan pulse provided during a preceding scan.

15. The display device according to claim 10, further comprising a crosstalk suppressor circuit which is inserted between said capacitive element and said switching diode element, and which cuts a connection between said capacitive element and said switching diode element during the OFF state of said switching diode element.

16. The display device according to claim 15, wherein said crosstalk suppressor circuit includes:

a first diode element inserted in the same direction of polarity as that of said switching diode element between said capacitive element and said switching diode element; and a second diode element which has one end connected to a connection point between said switching diode element and said first diode element, and becomes an ON state during the OFF state of said switching diode element, thereby providing a second predetermined potential to the connection point between said switching diode element and said first diode element to allow said first diode element to be in an OFF state.

17. The display device according to claim 16, wherein the other end of said second diode element is connected to a line along with the one end of said capacitive element.

* * * * *